United States Patent [19]

Nitta

[11] Patent Number: 4,898,210

[45] Date of Patent: Feb. 6, 1990

[54] GAS-CYLINDER VALVE

[75] Inventor: Jiro Nitta, Hyogoken, Japan

[73] Assignee: Kabushiki Kaisha Neriki, Hyogoken, Japan

[21] Appl. No.: 293,430

[22] Filed: Jan. 4, 1989

[30] Foreign Application Priority Data

Jan. 12, 1988 [JP] Japan ..... 63-2829

[51] Int. Cl.[4] ..... F16K 51/00; F16K 31/44

[52] U.S. Cl. ..... 137/614.19; 137/316; 251/14

[58] Field of Search ..... 137/613, 614.19, 316; 251/63.5, 335.2, 14; 92/62

[56] References Cited

U.S. PATENT DOCUMENTS

| | | | |
|---|---|---|---|
| 3,741,245 | 6/1973 | West | 92/62 |
| 3,885,589 | 5/1975 | Iung | 137/613 |
| 4,585,207 | 4/1986 | Shelton | 92/62 |
| 4,706,929 | 11/1987 | Kalaskie et al. | 137/316 |
| 4,768,543 | 9/1988 | Wienke et al. | 137/240 |
| 4,776,562 | 10/1988 | Kalaskie et al. | 251/63.5 |

*Primary Examiner*—A. Michael Chambers

*Attorney, Agent, or Firm*—Lowe, Price, LeBlanc, Becker & Shur

[57] ABSTRACT

In a gas-cylinder valve adapted to be mounted onto a gas cylinder for use there are provided a gas supply valve chamber and a protection valve chamber in sequence between a gas inlet and a gas outlet within a valve box of the gas-cylinder valve. The gas supply valve chamber is provided with a gas supply valve body and the protection valve chamber is provided with a protection valve body. When the gas outlet of the gas-cylinder valve is opened to the atmosphere, the protection valve body serves to prevent ambient air, and moisture and/or dust in it from entering the gas supply valve chamber thereby avoiding damage to the valve and leakage of gas from the valve.

7 Claims, 4 Drawing Sheets

GAS-CYLINDER VALVE

BACKGROUND OF THE INVENTION

1. Field of the Invention

The present invention relates to a gas-cylinder valve to be employed in a gas cylinder which serves to store a dangerous gas which must not be leaked outside, for example a poison gas, an inflammable gas and the like.

2. Background of the Prior Art

For safe transfer of a gas contained within a gas cylinder, the basic construction of the gas-cylinder valve is disclosed, for example in U.S. Pat. No. 4,768,543 (date of Patent: Sept. 6, 1988).

In this known structure a gas inlet is in communication with a gas outlet through a gas inlet passage, a gas supply valve chamber and a gas outlet passage within a valve box of the gas-cylinder valve, said gas supply valve chamber is provided with a gas supply valve body and said gas supply valve body is adapted to be operatively opened and closed with respect to a valve seat of the gas supply valve chamber by means of a gas supply valve operation means.

In this basic construction, conventionally the gas supply valve chamber is constructed so as to be always in communication with the gas outlet through the gas outlet passage.

However, in this gas-cylinder valve, the gas outlet thereof is opened to the atmosphere when such occur as mentioned in the following:

(a) At the time of the removal of a gas charging connector from the gas outlet after the completion of the gas charging into the gas cylinder by a gas manufacturer.

(b) In the case that the outlet of the gas-cylinder valve is not closed by means of an outlet cap during the custody as well as the transportation of the gas cylinder.

(c) During the connection of a gas takeout connector to the gas outlet of the gas-cylinder valve after the removal of the outlet cap by a user.

In case that the gas outlet of the gas-cylinder valve is opened to the atmosphere in that way, there are the following problems associated with the gas-cylinder valve having the above-mentioned conventional construction.

Since the gas supply valve chamber is always in communication with the gas outlet through the gas outlet passage, the atmospheric air is apt to enter the gas supply valve chamber through the gas outlet and the gas outlet passage together with foreign substances such as moisture, rain, dust and the like. Since these foreign substances are apt to corrode and damage the gas supply valve body and the valve seat, it is apprehended that a dangerous gas stored within a gas cylinder may in time leak to the atmosphere.

For example, if the gas stored within the gas cylinder is $Cl_2$ (Chloride), HCl (Hydrogen Chloride), $WF_6$ (Hexafluotungsten), $Si_2F_6$ (Hexafluodisilan) or $BF_3$ (Boron Trifluoride), when moisture and/or rain enter the gas supply valve chamber, such a gas causes a chemical reaction with the moisture and the rain within the gas supply valve chamber so as to make strong acid liquid at the beginning of the takeout of the gas within the gas cylinder after opening the gas supply valve body. The gas supply valve body and the valve seat are accidentally corroded by the strong acid liquid.

Also when dust enters the gas supply valve chamber, it may locate between the gas supply valve body and the valve seat at the time of the opening and closing operation of the gas supply body so that these members are eventually damaged.

SUMMARY OF THE INVENTION

The primary object of the present invention is to prevent a gas leakage at a gas supply valve body, which is apt to be caused entry therein of moisture, rain, dust and the like contained in the ambient atmospheric air.

Another object of the present invention is to prevent a gas from leaking outside a gas-cylinder valve even though a gas leakage might be caused casually at a gas supply valve body by using the gas supply valve body over its useful life.

For accomplishing the above-mentioned objects, the present invention is intended to improve the above-mentioned basic construction, such that a protection valve chamber is interposed in the gas outlet passage within the valve box of the gas-cylinder valve, the protection valve chamber is provided with a protection valve body, and the protection valve body is adapted to be operatively opened and closed by means of a protection valve operation means with respect to a valve seat of the protection valve chamber.

The gas-cylinder valve according to the present invention is used as follows.

Except when a gas is charged into the gas cylinder or when a gas is taken out from the gas cylinder, both the gas supply valve body and the protection valve body are closed.

When the gas outlet is opened to the atmosphere, the atmospheric air enters the protection valve chamber from the gas outlet through the gas outlet passage. But the protection valve body is then closed so that the gas can be prevented from entering the gas supply valve chamber.

When a user takes out a gas from the gas cylinder, a gas takeout connector is first connected to the gas outlet of the gas-cylinder valve and then the gas supply valve body is opened and, successively, the protection valve body is opened. Thereupon, a high pressure gas within the gas cylinder flows from the gas inlet through the gas supply valve chamber, and the protection valve chamber in that order, and is forced into a gas takeout pipe from the gas outlet through any gas takeout connector. At that time, the air and any dust or moisture in it which has already entered the protection valve chamber is pushed out from the gas outlet into the gas takeout pipe with some mixing with the gas so as to be prevented from entering the gas supply valve chamber.

The operation for charging a gas into an empty gas cylinder is carried out by a gas manufacturer according to the following procedure. Firstly, a gas charging connector is connected to the outlet of the gas-cylinder valve and then a vacuum suction process is carried out before the gas charging operation so that a residual gas and an air within the gas cylinder can be sucked out sufficiently. In conjunction with the vacuum suction process, the air which has already entered the protection valve chamber and the gas outlet passage of the gas-cylinder valve is sucked outside. Under this condition, the gas is adapted to be charged into the gas cylinder. Since the air which has entered the protection valve chamber and the gas outlet passage is sucked outside previously by means of the vacuum suction process in that way, the air is prevented from entering the gas supply valve chamber when the protection valve body is opened.

As noted above, according to the present invention, since the atmospheric air as well as moisture, rain, dust and the like mixed in the air can be prevented from entering the gas supply valve chamber by the protection valve body, the following advantages can be attained.

Even in the case that a gas stored within the gas cylinder is such one as to make strong acid liquid due to a chemical reaction with the moisture and the rain, since the moisture and the rain are prevented from entering the gas supply valve chamber, the gas supply valve body and the valve seat can be effectively prevented from being corroded. If the gas stored within the gas cylinder is dangerous if leaked, e.g., it is inflammable, entrapment of dust mixed in the air between the gas supply valve body and the valve seat so as to damage these members is prevented and this prevents leakage of gas. Accordingly, it is possible to prevent a dangerous gas such as a poison gas, an inflammable gas and the like from leaking outside the gas supply valve body.

Even if gas leakage is occurs due to prolonged use of the gas supply valve body over its lifetime, since the dangerous gas which leaks from the gas supply valve body to the gas supply valve chamber can be blocked by means of the protection valve body, an accident due to dangerous gas leaks outside the gas-cylinder valve can be prevented.

Other objects, features and advantages of the present invention will be readily apparent from the following description taken in conjunction with the following drawings.

BRIEF DESCRIPTION OF THE DRAWINGS

FIGS. 1 through 3 show a first embodiment thereof;

FIG. 1 is a vertical sectional view of a gas-cylinder valve;

FIG. 2 is a partial sectional view of the gas-cylinder valve under such a condition as during the custody and the transportation thereof;

FIG. 3 is a partial sectional view of the gas-cylinder valve under such a condition that a hand-manipulated type valve opening operation member is attached to a power-operated type gas supply valve operation means;

FIG. 4 shows a second embodiment of the present invention and is a vertical sectional view of the gas-cylinder valve thereof; and FIG. 5 is a partial view showing a variant example of a protection valve body.

DESCRIPTION OF THE PREFERRED EMBODIMENTS

Figure 1:
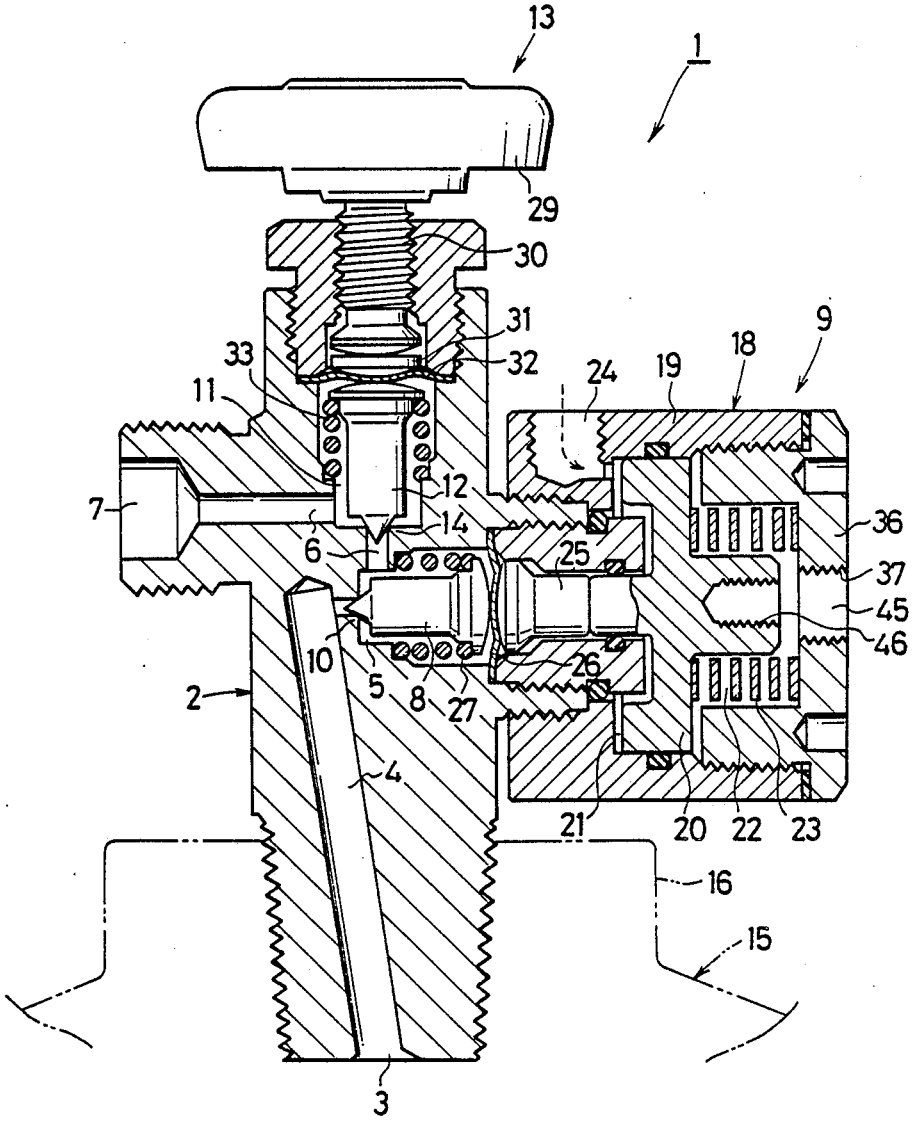
FIGS. 1 through 5 show preferred embodiments of the present invention.
Figure 2:
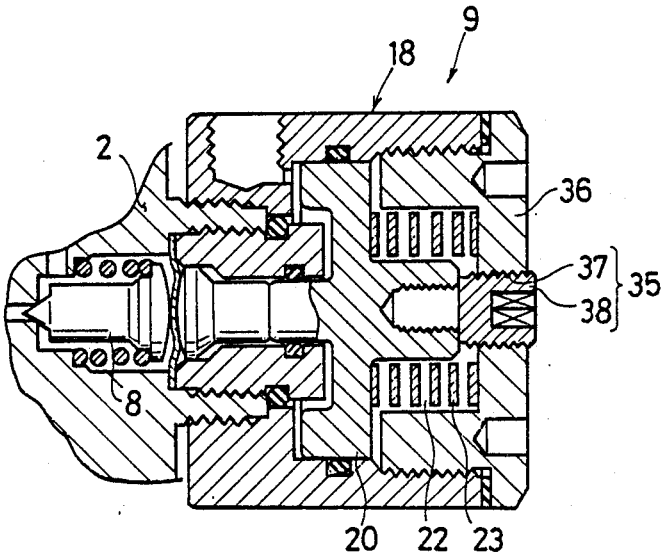
Figure 3:
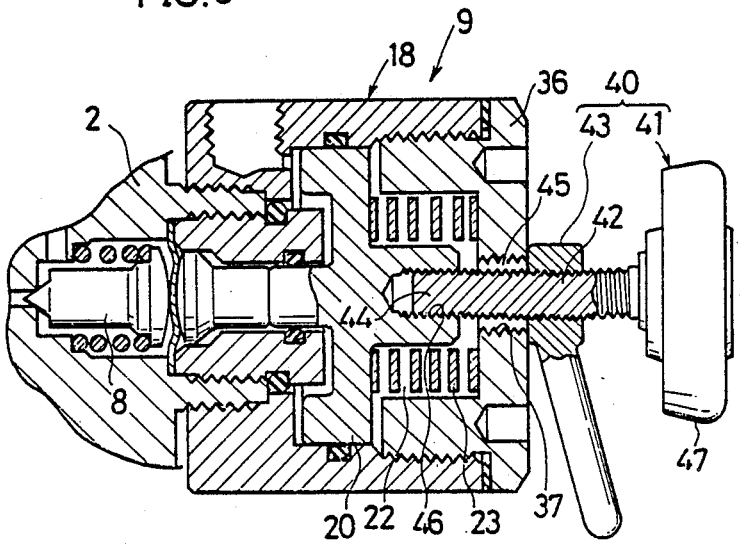

FIGS. 1 through 3 show the first preferred embodiment of the present invention.

As shown in FIG. 1, a gas-cylinder valve 1 is provided with a longitudinally longer valve box 2. In this valve box 2, a gas outlet 7 is in communication with a gas inlet 3 which is opened downward in the lower surface of valve box 2, through a gas inlet passage 4, a gas supply valve chamber 5 and a gas outlet passage 6. The gas outlet 7 is opened laterally in a side surface of the valve box 2 (the left side in the view of FIG. 1).

The gas supply valve chamber 5 is formed laterally in a middle height portion of the valve box 2 and is provided with a gas supply valve body 8 therewithin. The gas supply valve body 8 is adapted to be opened and closed operatively by a gas supply valve operation means 9 with respect to a valve seat 10 of the gas supply valve chamber 5. A protection valve chamber 11 is interposed in an intermediate portion of the gas outlet passage 6. The protection valve chamber 11 is formed vertically in an upper portion of the valve box 2 and provided with a protection valve body 12 therewithin. The protection valve body 12 is adapted to be opened and closed operatively by a protection valve operation means 13 with respect to a valve seat 14 of the protection valve chamber 11.

Gas cylinder 15 has a mouth portion 16 adapted for mounting of the gas-cylinder valve 1 there at.

The gas supply valve operation means 9 per FIG. 1 is explained hereinafter. It is of a pneumatically powered-operated type and is projected laterally from a middle height portion of the valve box 2 and constructed as follows.

A cylinder body 19 of an air cylinder (a hydraulic cylinder) 18 is threadably secured to the valve box 2 at its middle height portion. A pneumatic actuation chamber (a hydraulic actuation chamber) 21 is arranged at one side of a piston 20 within the cylinder body 19 and a spring chamber 22 is arranged at the other side of a piston 20 therewithin. The spring chamber 22 is provided with a valve closing spring 23 composed of a compression coil spring. 24 indicates a pressurized air supply/discharge port. Pressurized air is supplied to or discharged from the pneumatic actuation chamber 21 by a supply/discharge control means (not illustrated) adapted to be connected to the pressurized air supply/-discharge port 24.

Further, the piston 20 is connected interlockingly with the gas supply valve body 8. That is, under such a valve closing operative condition that pressurized air is discharged from the pneumatic actuation chamber 21, the piston 20 is advanced left by means of the valve closing spring 23. The gas supply valve body 8 is thereby pushed onto the valve seat 10 against a valve opening spring 27 through an actuation pin 25 and a diaphragm 26 of a plate spring so as to perform the correspond valve closing.

To the contrary, under such a valve opening operative condition that a pressurized air is supplied to the pneumatic actuation chamber 21, the piston 20 is retracted right by a pneumatic pressure within the pneumatic actuation chamber 21 against the valve closing spring 23. The gas supply valve body 8 is thereby pushed right by the valve opening spring 27 so as to perform the valve opening.

The protection valve operation means 13 will be explained hereinafter. It is preferably of a hand-manipulated type and is arranged vertically in the upper portion of the valve box 2 in an upward projecting manner and is constructed as follows.

When handle 29 is so turned that a valve spindle 30 can be advanced downward, the protection valve body 12 is pushed onto the valve seat 14 thereby through a revolution absorbing member 31 and a diaphragm 32 of a spring plate against the valve opening spring 33 so as to perform the valve closing. On the contrary, when the handle 29 is so turned reversely that the valve spindle 30 can be retracted upward, the protection valve body 12 is pushed upward by the valve opening spring 33 so as to perform the protection valve opening.

As shown in FIG. 2, in the gas-cylinder valve 1 having the above-mentioned construction, a hand-manipulated type valve closing means 35 may be additionally mounted in the gas supply valve operation means 9. It is employed for keeping the gas supply valve body 8 in a forcedly closed state during the transportation of the gas cylinder 15 and is constructed as follows.

The hand-manipulated type valve closing means 35 comprises a threaded hole 37 formed so as to run through an end wall 36 of the spring chamber 22 and a pushing member 38 threadably engaged with the threaded hole 37. During the transportation of the gas cylinder 15, the pushing member 38 is kept in an advanced position toward the piston 20, to which position it has been turned previously. Thereupon, the piston 20 is kept pushed left by the thrust transmitted by the pushing member 38 so that the gas supply valve body 8 can be held strongly in its closed position.

In this way, the gas supply valve body 8 is kept closed by a large force obtained by summing up the resilient force of the valve closing spring 23 and the thrust transmitted by the pushing member 38. Therefore, the gas supply valve body 8 is prevented from being opened by vibration and shock acting thereon during the transportation and a gas leakage can be effectively prevented. When the gas takeout is desired by a user, the pushing member 38 is removed from the threaded hole 37.

Further, as shown in FIG. 3, a hand-manipulated type valve opening operation member 40 may be attached to the gas supply valve operation means 9. It is employed in the case that a pressurized fluid source such as a pressurized air source and the like is not available readily around the setting up location for the gas cylinder 15 and in the case that the gas supply valve body 8 is intended to be opened manually, and it is constructed as follows.

The hand-manipulated type valve opening operation member 40 comprises a bolt member 41 and a nut member 43 which is displaceably threadably engaged with a threaded leg portion 42 of the bolt member 41. The threaded leg portion 42 is provided at its leading end portion with a pulling engagement portion 44. A through hole 45 for the pulling engagement portion 44 to pass is composed of the inner space of the threaded hole 37 formed in the end wall 36 of the spring chamber 22. A fitting threaded hole is formed as an engagement portion 46 to be engaged with the pulling engagement portion 44 in the end portion of the piston 20 so as to face the through hole 45.

The hand-manipulated type valve opening operation member 40 is used as follows.

First, the bolt member 41 and the nut member 43 are set up as shown in FIG. 3. Next, while a handle 47 of the bolt member 41 is held by one hand of an operator so as not to be turned, the nut member 43 is turned clockwise by the other hand thereof. Thereupon the bolt member 41 is retracted to the right (as illustrated) and the piston 20 is pulled right thereby against the valve closing spring 23 so that the gas supply valve body 8 can be opened.

On the contrary, when the gas supply valve body 8 is intended to be closed, the nut member 43 is turned counterclockwise. Thereupon, the bolt member 41 is advanced left so that the piston 20 is allowed to be advanced left by the valve closing spring 23.

When a user starts to use a gas flow through the gas-cylinder valve 1 having the above-mentioned construction, the gas takeout connector (not illustrated) is first connected to the gas outlet 7, then the gas supply valve body 8 is opened by the hand-manipulated type valve opening operation member 40 or by a pneumatic pressure within the air cylinder 18 and, lastly, the protection valve body 12 is opened manually. Thereupon, a high pressure gas from within the gas cylinder 15 flows from the gas inlet 3 through the gas supply valve chamber 5 and the protection valve chamber 11, in that order, and is forced from the gas outlet 7 to the gas takeout pipe through the gas takeout connector. Any air which has entered the protection valve chamber 11 is expelled from the gas outlet 7 to the gas takeout pipe together with the takeout gas mixed therewith so that air is prevented from entering the gas supply valve chamber 5.

After starting the gas takeout, the protection valve body 12 is kept in a valve opening operative condition and the gas takeout is carried out and stopped by remotely opening and closing the gas supply valve body 8 through the air cylinder 18.

In this way, since the gas supply valve operation means 9 is of a power-operated type and the protection valve operation means 13 is of a simple hand-manipulated type, the gas takeout can be carried out and stopped remotely readily and the structure of the gas-cylinder valve 1 can be made small in size. Since the gas supply valve operation means 9 is arranged laterally in the peripheral portion of the valve body 2 and the protection valve operation means 13 is arranged vertically in the upper portion of the valve box 2, the open space above the valve box 2 is available for an easy operation of the handle 29. Further, since the power-actuating device of the gas supply valve operating means 9 is composed of the air cylinder (the hydraulic cylinder) 18 of a single acting spring actuation type and the gas supply valve body 8 is adapted to be closed by the valve closing spring 23, the gas-cylinder valve 1 can be kept closed readily for a long time, and transportation and custody of the gas cylinder 15 can be done conveniently.

Figure 4:
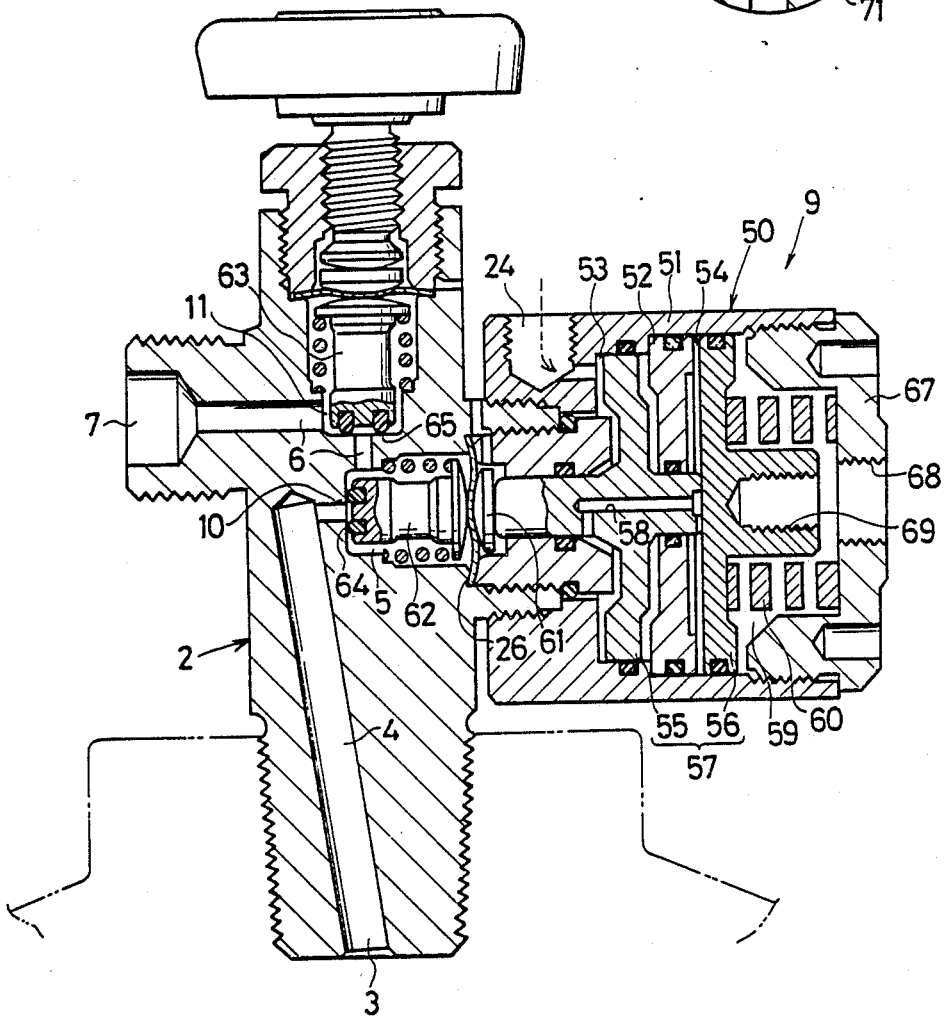

FIG. 4 shows the second embodiment which is attained by modifying a portion of the gas supply valve operation means 9 as follows. The same component parts as the ones employed in the above-mentioned first embodiment are indicated by the same symbols.

There is provided a partition plate 52 within a cylinder body 51 of an air cylinder (a hydraulic cylinder) 50 so that pneumatic actuation chambers (hydraulic actuation chambers) 53, 54 are arranged in series at the left and right opposite sides of the partition plate 52. A piston 57 is composed of separate pistons 55, 56 respectively disposed in these pneumatic actuation chambers 53, 54. The left separate piston 55 is slidably passed through the partition plate 52 in an air-tight manner so as to be abutted against the right separate piston, and both the left and right pneumatic actuation chambers 53, 54 are communicated with each other by a communication hole 58 formed in the left separate piston 55. Further, a stronger spring than the one employed in the first embodiment is employed for a valve closing spring 60 within a spring chamber 59.

The air cylinder 50 functions as follows. Under such a valve closing operative condition such that pressurized air is discharged from the pneumatic actuation chambers 53, 54, both the separate pistons 55, 56 are advanced left strongly by the valve closing spring 60. Since a gas supply valve body 62 is strongly brought in contact with the valve seat 10 through an actuation pin 61 and the diaphragm 26 so as to perform the valve closing, the sealing capability of the gas supply valve body 62 is thereby enhanced. On the contrary, under a valve opening operative condition such that pressurized air is supplied to the pneumatic actuation chambers 53, 54, the resultant force of the pneumatic actuation forces acting respectively on the separate pistons 55, 56 surpasses the force of the valve closing spring 60 so that both the separate pistons 55, 56 can be retracted right and the gas supply valve body 62 can be closed.

According to this construction, the sealing capability of the gas supply valve body 62 is enhanced by the strong valve closing spring 60 and a cylinder body 51 of the air cylinder 50 can be made small in size. Since the communication hole is formed within the piston 57, the external diameter of the air cylinder 50 can be decreased differently from one that has to be provided with piping outside the cylinder body 51. According to the above-mentioned construction, the whole of the gas-cylinder valve can be made compact.

The gas supply valve body 62 and the protection valve body 63 have their sealing capabilities enhanced by forming the respective valve surfaces 64, 65 thereof in an annular configuration from a synthetic resin such as fluorine contained resin and the like.

Similarly to the first embodiment, a threaded hole 68 is formed in an end wall 67 of the spring chamber 59 as well as an engagement portion 69 is formed in the right separate piston 56.

Figure 5:
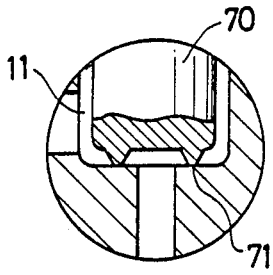

FIG. 5 shows yet another embodiment, with a modified form of the protection valve body 70. In this case, an annular valve surface 71 is formed integrally in the lower surface of the protection valve body 70 in a projecting manner so that a sufficient sealing capability can be obtained, with consideration given to whether the kind of gas involved can be harmful to synthetic resin components. Also the gas supply valve body 62 shown in FIG. 4 may be formed similarly to the protection valve body 70.

To obtain other embodiments of the present invention, a portion of each of the above-mentioned each embodiments may be modified according to the following items A through E:

A. The gas supply valve operation means may be modified to a hydraulically operated type, an electrically operated type, other power-operated types, or a hand-manipulated type.

B. The protection valve operation means may be modified to a pneumatically operated type, a hydraulically operated type, an electrically operated type, or other power-operated types.

C. The operation means mentioned in the items of A and B may be suitably combined each other.

D. The gas supply valve operation means may be arranged vertically in the upper portion of the valve box and the protection valve operation means may be arranged projectingly in the lateral portion of the valve box, and accordingly, the gas supply valve chamber may be formed vertically and the protection valve chamber may be formed laterally.

E. The gas outlet may be opened in the upper surface of the valve box and the projection valve operation means may be arranged laterally projectingly from the valve box. Accordingly, the protection valve chamber may be formed laterally.

Still other objects and advantages of the present invention will become readily apparent to those skilled in this art from the preceding detailed description, wherein only the preferred embodiments of the invention are illustrated and described, as aforementioned, simply by way of presenting the best modes contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive, the invention being defined solely by the claims appended hereto.

I claim:

1. A gas-cylinder valve adapted for securely controlling gas flow from a gas cylinder, comprising:

a one piece valve box having a gas inlet in communication with a gas outlet through a gas inlet passage, a gas supply valve chamber, a gas outlet passage and a metallic diaphragm sealing one end of said gas supply valve chamber within said valve box of said gas-cylinder valve;

a gas supply valve body movably supported in said gas supply valve chamber;

gas supply valve operation means for moving said gas supply valve body with respect to a first valve seat of the gas supply valve chamber to correspondingly open and close off said communication between said gas inlet and outlet passages;

said one piece valve box further including a protection valve chamber interposed downstream of said gas supply valve seat in said gas outlet passage within the valve box, said protection valve chamber being provided with a metallic diaphragm for sealing one end thereof and a movable protection valve body adapted to open and close off said gas outlet passage by controlled movement with respect to a second valve seat of the protection valve chamber;

spring means within each said gas supply valve chamber and said protection valve chamber for biasing said valve bodies in the direction of said metallic diaphragms; and means to transmit valve operational forces to said diaphragms for opposing said biasing forces of said spring means and gas pressures acting on said diaphragms from within said valve chambers.

2. A gas-cylinder valve according to claim 1, wherein:

said gas supply valve operation means is of a power-operated type, and said protection valve operation means is of a hand-manipulated type.

3. A gas-cylinder valve according to claim 2, wherein:

said gas supply valve operation means is arranged laterally in a peripheral portion of the valve box, and said protection valve operation means is arranged vertically in an upper portion of the valve box.

4. A gas-cylinder valve according to claim 2, wherein:

said gas supply valve operation means comprises a hydraulic cylinder of a single acting spring actuated type, and a cylinder body of said hydraulic cylinder is fixedly secured to said valve box, there are provided a hydraulic actuation chamber, a piston and a spring chamber in order from near the gas supply valve body within said cylinder body, and said piston is connected interlockingly with the gas supply valve body and said spring chamber comprises a compression type valve closing spring, and said gas supply valve body is adapted to be resiliently urged to its valve closing position by the valve closing spring providing a force through the piston, and said piston is adapted to be returned to its valve opening position against the valve closing spring by a pressurized fluid supplied to the hydraulic actuation chamber, whereby the gas supply valve body can be opened.

5. A gas-cylinder valve according to claim 4, further comprising:

a hand-manipulated type valve closing means for pushing and securing said piston to its valve closing position, arranged in parallel with the valve closing spring, said hand-manipulated type valve closing means comprising a threaded hole formed in an end wall of the spring chamber and a pushing member threadably engaged with the threaded hole so as to be adjustably advanced and retreated.

6. A gas-cylinder valve according to claim 4, further comprising:

a hand-manipulated type valve opening operation member adapted to be additionally attached to said gas supply valve operation means in order to pull the piston to its valve opening position, with a through hole for a pulling engagement portion of said hand-manipulated type valve opening operation member to pass therethrough formed in the end wall of the spring chamber and an engagement portion adapted to be engaged with said pulling engagement portion formed in the end portion of the piston so as to face the through hole.

7. A gas-cylinder valve according to claim 4, further comprising:

a plurality of hydraulic actuation chambers connected in series within the cylinder body of said hydraulic cylinder, with separate pistons disposed respectively within the hydraulic action chambers and connected in series to each other so as to form a composite piston, said hydraulic actuation chambers being adapted to be communicated with each other through a communication hole formed within the composite piston.

* * * * *